US006964595B2

(12) United States Patent
Libretti

(10) Patent No.: US 6,964,595 B2
(45) Date of Patent: Nov. 15, 2005

(54) CHILD'S INFANT-CARE PLAY CENTER

(75) Inventor: Elizabeth A. Libretti, Santa Monica, CA (US)

(73) Assignee: Mattel, Inc, El Segundo, CA (US)

( * ) Notice: Subject to any disclaimer, the term of this patent is extended or adjusted under 35 U.S.C. 154(b) by 82 days.

(21) Appl. No.: 10/327,381

(22) Filed: Dec. 20, 2002

(65) Prior Publication Data

US 2005/0227581 A1 Oct. 13, 2005

(51) Int. Cl.[7] ..... A63H 33/30
(52) U.S. Cl. ..... 446/482; 446/175; 446/484; 108/25; 5/655; 5/606
(58) Field of Search ..... 446/482, 476–479, 446/483, 484, 397, 297, 227, 71–76, 81; 4/580, 631, 594, 646; 312/228, 229; 108/24–26, 108/50.11, 50.18; 297/174 CS, 174 R, 188.1; 5/655, 606; D06/383, 382, 390, 391, 397

(56) References Cited

U.S. PATENT DOCUMENTS

| | | | | | |
|---|---|---|---|---|---|
| 569,901 | A | * | 10/1896 | Bock | 266/141 |
| 1,082,082 | A | * | 12/1913 | Jiranek | 108/93 |
| 1,409,330 | A | * | 3/1922 | Aper | 312/228 |
| 1,724,479 | A | * | 8/1929 | Havener | 4/550 |
| 1,827,687 | A | * | 10/1931 | McCandless | 108/143 |
| 2,127,047 | A | * | 8/1938 | Russell | 446/482 |
| 2,819,142 | A | * | 1/1958 | BGarrett | 312/309 |
| 3,113,901 | A | * | 12/1963 | Jphigen et al. | 156/345.21 |
| 3,261,651 | A | * | 7/1966 | Prowse | 312/290 |
| 3,269,034 | A | * | 8/1966 | Glass et al. | 446/482 |
| 3,427,666 | A | * | 2/1969 | Saxe | 5/2.1 |
| 3,577,675 | A | | 5/1971 | Kohner | 46/41 |
| 3,955,307 | A | | 5/1976 | Payton | 46/12 |
| 3,993,376 | A | * | 11/1976 | Meldahl | 312/228 |
| 4,030,235 | A | * | 6/1977 | Terzian et al. | 446/296 |
| 4,057,244 | A | | 11/1977 | Gaspar | 272/1 A |
| 4,139,967 | A | | 2/1979 | Kuna et al. | 46/12 |

(Continued)

FOREIGN PATENT DOCUMENTS

EP 834273 A2 * 4/1998 ..... A47D 5/00

(Continued)

OTHER PUBLICATIONS

Baby Center Nursery from Berchet, Internet—www. Ride-Toys.com, 1996.*

(Continued)

*Primary Examiner*—Derris H. Banks
*Assistant Examiner*—Urszula M. Cegielnik
(74) *Attorney, Agent, or Firm*—James G. O'Neill; Klein, O'Neill & Singh, LLP

(57) ABSTRACT

A child's infant-care play center includes a table having a recessed bath tub and a changing-table/bed removably disposed over the tub. Upstanding dividers and a headboard demarcate respective bathing/changing/sleeping and washing-sink/eating areas on the table. A flexible conduit having a faucet attached at one end is extractible from and retractable into one of the dividers, and an electronic element selectably to generate and couple the sound of running water through the conduit and out the faucet. A mobile mounted over the bathing/changing/sleeping area may be selectably actuated to rotate conjointly with an accompanying melody. A baby monitor includes a portion fixed to the upper surface of the table, a portable portion, and elements for selectably generating and projecting one of a variety of baby sounds through the fixed portion. A free-standing booster chair that converts to a potty can be removably supported on an edge of the table.

18 Claims, 2 Drawing Sheets

U.S. PATENT DOCUMENTS

| | | | | | |
|---|---|---|---|---|---|
| 4,194,318 | A | | 3/1980 | Watanabe | 46/202 |
| 4,332,101 | A | * | 6/1982 | Tomita | 446/24 |
| 4,333,258 | A | * | 6/1982 | McCaslin | 446/481 |
| 4,342,173 | A | | 8/1982 | Otake | 46/1 R |
| 4,467,553 | A | | 8/1984 | Kanda | 446/136 |
| 4,568,302 | A | * | 2/1986 | Henderson | 446/186 |
| 5,215,491 | A | * | 6/1993 | Willet et al. | 446/176 |
| D342,295 | S | * | 12/1993 | Houry et al. | D21/483 |
| 5,454,745 | A | | 10/1995 | Spielberger | 446/71 |
| 5,672,088 | A | | 9/1997 | Chininis | 446/227 |
| 5,706,613 | A | | 1/1998 | Drake, Jr. et al. | 52/79 |
| 5,732,999 | A | * | 3/1998 | Petrie | 297/136 |
| 5,758,690 | A | * | 6/1998 | Humpert et al. | 4/678 |
| 5,772,490 | A | | 6/1998 | Leach | 446/71 |
| D396,072 | S | * | 7/1998 | Katzman et al. | D21/524 |
| 5,778,273 | A | * | 7/1998 | Ben-Yaacov | 396/598 |
| D407,757 | S | * | 4/1999 | Blumenthal | D21/524 |
| D413,151 | S | * | 8/1999 | Breuil | D21/519 |
| 5,974,989 | A | * | 11/1999 | Liu | 446/298 |
| 6,016,926 | A | | 1/2000 | Smith, II et al. | 200/119 |
| 6,066,022 | A | | 5/2000 | Fobean et al. | 446/227 |
| 6,135,845 | A | * | 10/2000 | Klimpert et al. | 446/297 |
| 6,151,737 | A | | 11/2000 | Henninge | 5/655 |
| 6,227,931 | B1 | * | 5/2001 | Shackelford | 446/268 |
| 6,256,803 | B1 | | 7/2001 | Sauerbrei et al. | 4/443 |
| 6,269,503 | B1 | | 8/2001 | Betker | 5/655 |
| 6,349,654 | B1 | * | 2/2002 | Peters | 108/26 |
| 6,358,113 | B1 | * | 3/2002 | Ruggiero | 446/482 |
| 6,439,957 | B1 | * | 8/2002 | MacCarthy | 446/479 |
| 6,547,628 | B1 | * | 4/2003 | Long | 446/227 |
| 6,547,635 | B1 | * | 4/2003 | Gildea | 446/479 |
| 6,641,455 | B2 | * | 11/2003 | Chan | 446/297 |
| 6,648,719 | B2 | * | 11/2003 | Chan | 446/297 |
| 2003/0153238 | A1 | * | 8/2003 | Chan | 446/175 |

FOREIGN PATENT DOCUMENTS

| | | | | | |
|---|---|---|---|---|---|
| EP | 1068822 | A1 | * | 1/2001 | A47D 5/00 |
| GB | 2076301 | A | * | 12/1981 | A63H 33/30 |
| JP | 2000213027 | A | * | 8/2000 | E03C 1/18 |

OTHER PUBLICATIONS

Tender Heart Doll Nursery, Internet—www.adverturetoys.co.uk, 2001.* http://web.archive.org/web/20011021085103/http://www.cditoys.com/products/doll/.2001.* http://www.toyscamp.com/viewproduct.asp?productld=BCT141127, 2001.* http://web.archive.org/web/20000208074014/http://.grannys.com/selecta.htm, 2000.* http://shop.store.yahoo.com/dianatoys2001-store/bebace.html, 2001.*

* cited by examiner

CHILD'S INFANT-CARE PLAY CENTER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO APPENDIX

Not Applicable

BACKGROUND OF THE INVENTION

1. Field of the Invention

This invention pertains to children's toys in general, and in particular, to a child's infant-care play center.

2. Description of Related Art

It has long been appreciated that children learn and mature not only through structured pedagogical activities, such as school, but also through play activities, such as games and role playing. In light of this, the prior art includes numerous examples of children's toys, games and "activity centers" that are adapted to teach as well as to entertain the child.

Those intended for infants and very young toddlers tend to be directed to developing the child's hand-eye coordination skills, such as the collapsible activity center described in U.S. Pat. No. 6,066,022 to E. Fobean et al., the infant bath toy described in U.S. Pat. No. 6,016,926 to D. Smith, II et al., the activity toy described in U.S. Pat. No. 5,454,745 to L. Spielberger, and the bathing toy described in U.S. Pat. No. 3,577,675 to F. Kohner et al.

Those intended for older children tend to be directed to developing the child's role-playing skills, and typically provide or establish an environment that is appropriate to the particular role being played. Examples of these can be found in: The electronic interactive play environment for toy characters described in U.S. Pat. No. 6,227,931 to J. Shackelford; the play-house described in U.S. Pat. No. 5,706,613 to R. Drake, Jr. et al.; the toy medical office de-scribed in U.S. Pat. No. 4,342,173 to M. Otake; the cooking toy described in U.S. Pat. No. 4,467,553 to S. Kanda; the toy ambulance unit described in U.S. Pat. No. 4,194,318 to S. Watanabe; the toy castle set described in U.S. Pat. No. 4,139,967 to W. Kuna et al.; the play seat apparatus described in U.S. Pat. No. 4,057,244 to P. Gaspar; the toy veterinarian kit described in U.S. Pat. No. 4,030,235 to R Terzian et al.; and, the doll house described in U.S. Pat. No. 3,995,307 to J. Payton.

While the above role-playing toys and play centers encompass a wide variety of role types, there is a dearth in the prior art of activity centers directed to the development of parenting skills, and in particular, to infant-care skills. A need therefore exists for an inexpensive, full-featured child's play center that is both entertaining, and yet engages the child in realistic infant-care play activities, e.g., the feeding, changing, bathing and monitoring activities typically associated with the parenting role of infant care.

BRIEF SUMMARY OF THE INVENTION

In accordance with the present invention, a child's play center is provided that enables the child to engage in realistic infant-care play activities in conjunction with a baby doll, e.g., feeding, changing, bathing and monitoring activities that are typically associated with the adult care of real infants.

In one exemplary embodiment, the play center of the invention comprises a table supported by a plurality of upstanding legs and having an upper surface with a recessed bath tub for a doll formed therein. A removable cover simulating a changing table and bed for the doll is slidably retained in an upper rim of the tub. A first upstanding divider disposed on the upper surface of the table at one side of the tub divides the surface into first and second play activity areas.

A second upstanding divider at a side of the tub opposite to the first divider, together with the first divider and an upstanding headboard disposed adjacent to and between corresponding ends of the two dividers, serve to characterize the first play activity area as a changing, sleeping, and bathing area for the doll. The second play area includes first and second recesses respectively simulating a washing sink and an eating tray, and together serve to characterize the second play area as a washing and eating area for the doll.

A hollow flexible conduit extends through an opening in a top surface of the first divider. The conduit has a first end external to the divider with a hollow simulated faucet attached thereto, and a second end captivated within the divider. This arrangement enables the child to extract the faucet and conduit from the opening and extend the faucet into either the first or second play areas for pretend bathing or washing of the doll, and to then retract the faucet and conduit back to the opening when done. In one preferred embodiment, the conduit and faucet comprise an acoustic channel that extends to an electronics compartment on the lower surface of the table. The compartment is acoustically coupled to the channel and includes electronic circuitry, including a loudspeaker, programmed to generate the sound of running water that is heard to come from the faucet in response to the actuation of a switch.

An upstanding arcuate arm has a lower end rotatably mounted on an upper surface of the second divider and an opposite, upper end that supports a rotating mobile over the first play area of the table. The mobile may be manually operated by the child, or may incorporate a small geared DC motor that causes it to rotate in response to the actuation of a switch by the child, and the compartment on the lower surface of the table includes electronic circuitry programmed to generate a melodic sound in conjunction with the rotation of the mobile.

In another preferred embodiment of the invention, the play center includes a simulation of a baby monitor that comprises a first portion fixed to the upper surface of the table, and a second portion that is portable and can be carried about by the child. The fixed portion of the monitor comprises another acoustic channel that is acoustically coupled to the electronic compartment on the lower surface of the table, and the compartment includes electronic circuitry programmed to selectably generate one of a plurality of baby sounds, e.g., a happy baby, a sleepy baby, or a fussy baby in response to the actuation of a switch by the child, and to project the selected sound through the fixed portion of the monitor.

The play center also includes a booster chair for the doll that includes a seat, a backrest, a plurality of upstanding legs, and means for removably supporting the chair on an edge of the table adjacent to the washing and eating area. The booster chair may include a recessed bowl below the seat, and the seat may be hinged to the chair for rotation up and back against the backrest to expose the recessed bowl for potty training of the doll.

The play center can additionally be provided with a number of appropriate play accessories, e.g., a spoon, a bowl, a baby lotion dispenser, a baby bottle and a simulated bottle warmer, and these can all be sized and shaped to conveniently store in the bath tub when the play center is not in use.

A better understanding of the above and many other features and advantages of the present invention may be obtained from a consideration of the detailed description thereof below, particularly if such consideration is made in conjunction with the figures of the appended drawings.

DETAILED DESCRIPTION OF THE INVENTION

Figure 1:
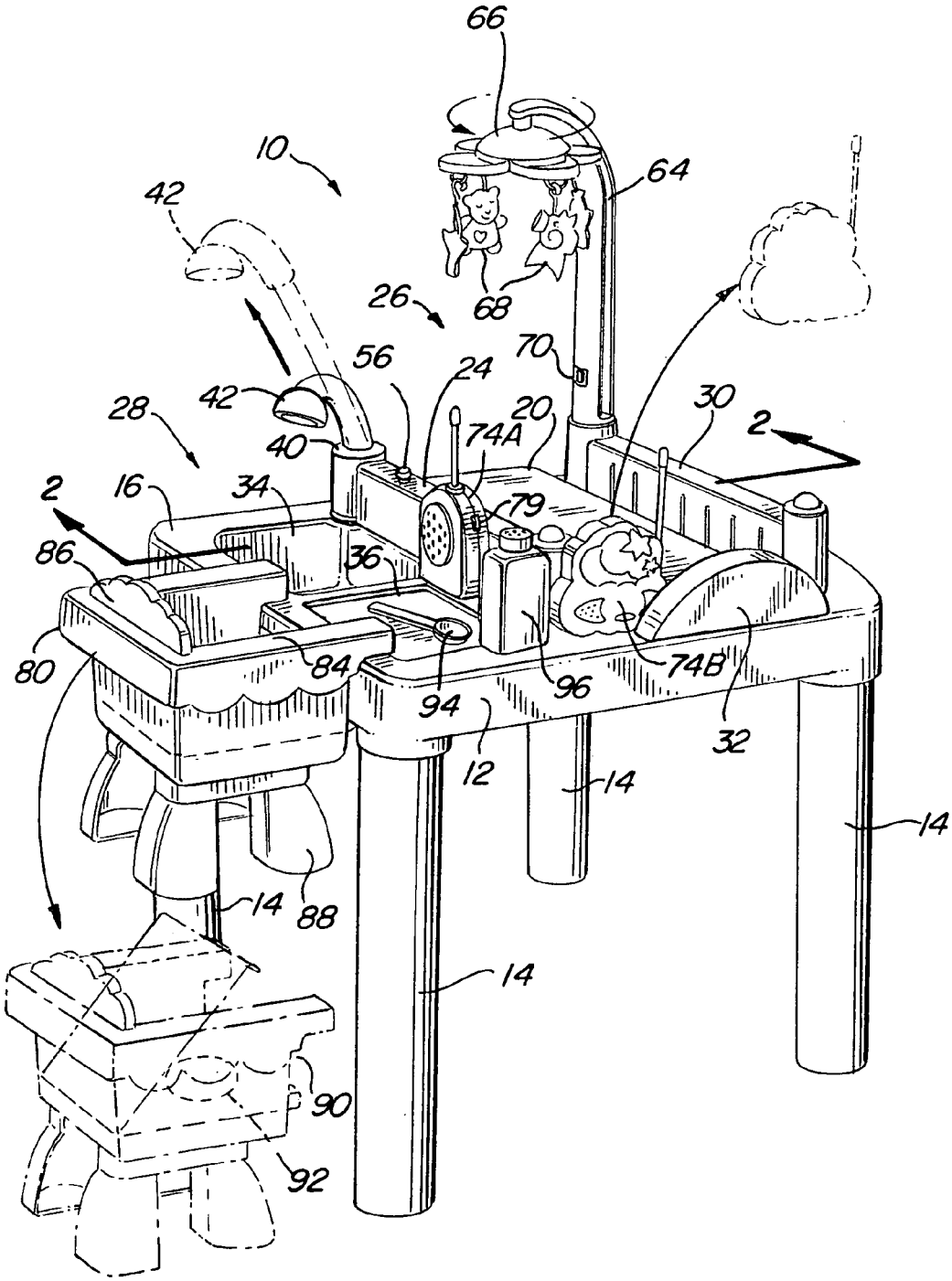
FIG. 1 is a top-side perspective view of an exemplary embodiment of a child's infant-care play center in accordance with the present invention.
Figure 2:
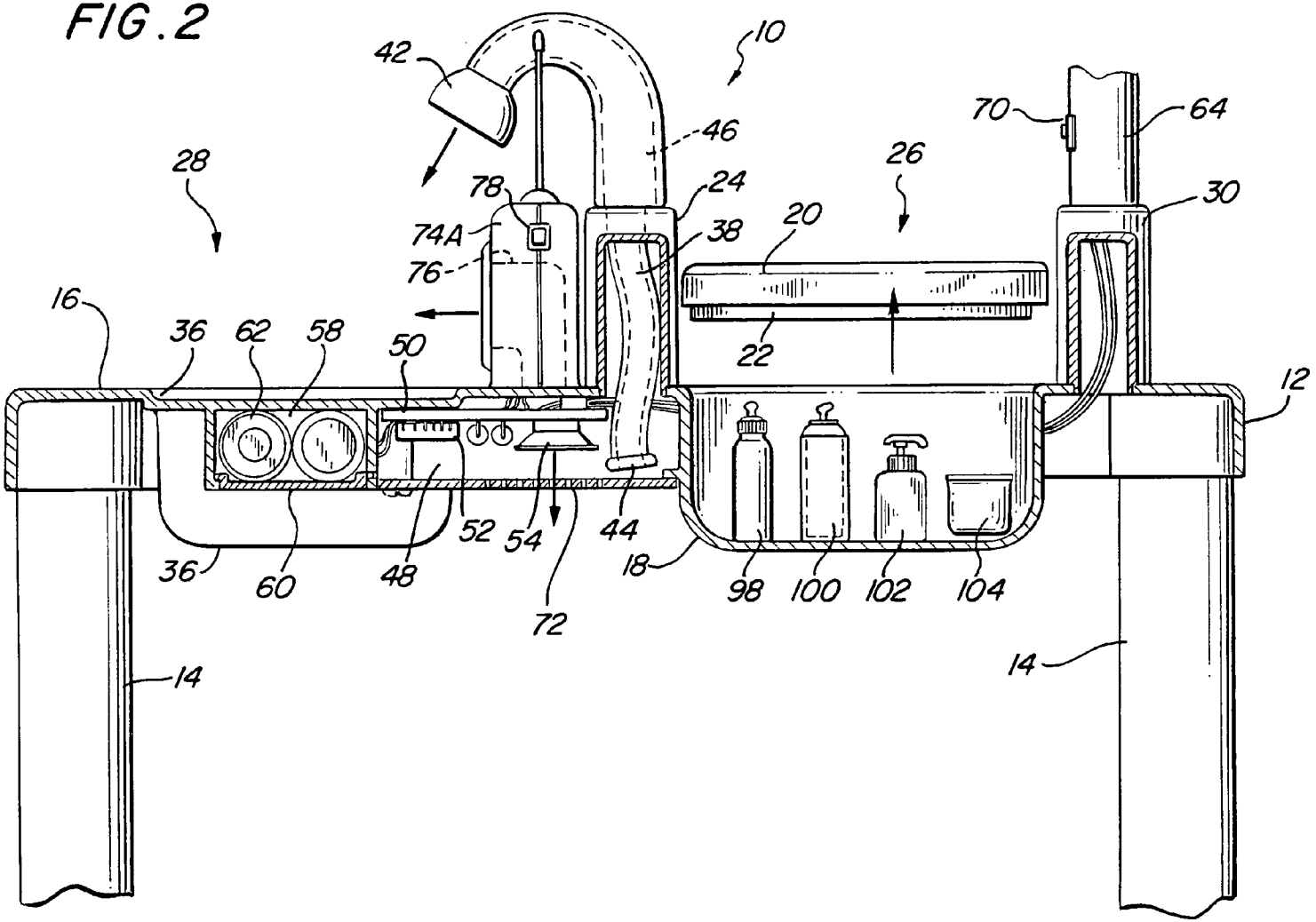
FIG. 2 is a partial cross-sectional view of the/play center, as revealed by the section taken along the lines 2—2 in FIG. 1.

An exemplary embodiment of a child's infant-care play center 10 is respectively illustrated in the perspective and partial cross-sectional views of FIGS. 1 and 2, and comprises a table 12 supported by a plurality of upstanding legs 14. The table includes an upper surface 16 into which a recessed bath tub 18 (see FIG. 2) for a doll (not illustrated) is formed. A removable tub cover 20 that doubles as a changing-table and a bed for the doll is movably retained in an upper rim of the tub by a lip or flange 22 (see FIG. 2) extending around a lower periphery thereof.

A first upstanding divider 24 is disposed on the upper surface 16 of the table 12 at one side of the tub 18, and divides the surface into first and second play areas 26 and 28. A second upstanding divider 30 disposed at the opposite side of the tub, together with the first divider and an upstanding headboard 32 disposed on the upper surface of the table adjacent to and between corresponding ends of the two dividers, serve to characterize the first play activity area 26 as a changing, sleeping, and bathing area for the doll.

The second play area 28 of the upper surface 16 of the table 12 includes a pair of recesses, viz., a washing-sink recess 34, and an eating recess 36, which together, serve to characterize the second play area as a washing and eating area for the doll.

In the exemplary preferred embodiment of the play center 10 illustrated, a flexible conduit 38, e.g., a thin-walled hose, extends through an opening in the top surface 40 of the first divider 24. The conduit has a first end with a hollow faucet 42 attached thereto exterior of the divider and a second end 44 (see FIG. 2) captivated within the divider for extensile and retractile movement of the faucet toward and away from the upper surface of the divider, as shown by the phantom outline in FIG. 1. Thus, the child can flexibly extend the faucet to either the first play area 26, e.g., to pretend-fill the doll's bath tub 18, or to the second play area 28, e.g., to pretend-fill the washing-sink 34, and then retract the faucet and conduit back to their original positions when done.

In the preferred embodiment, means are provided for selectably generating the sound of running water through the conduit 38 and faucet 42. In the particular embodiment illustrated, the conduit and faucet comprise an acoustic channel 46 (shown by dashed lines in FIG. 2) that is acoustically coupled to an electronics compartment 48 on a lower surface of the table 12, and the means for generating the water sounds is contained in the compartment in the form of, e.g., a circuit board 50 on which electronic circuitry 52, including a loudspeaker 54, is implemented.

The electrical circuitry 52 may comprise, for example, one or more PROgrammable Memories ("PROMs") into which the recorded sound of running water has been stored in digital form, together with a digital-to-analog converter ("DAC") and an amplifier connected to the speaker 54. Thus, the speaker plays back the recorded sound whenever an on-off knob or switch 56 (see FIG. 1) is actuated by the child, and the child hears the sound as coming from the faucet 42. A battery compartment 58 (see FIG. 2) with an access door 60 may also be provided on the lower surface of the table 12 to hold one or more batteries 62, e.g., C-cells, that provide safe electrical power for the various electrical functions described above and below. The exemplary play center 10 further includes an arcuate support arm 64 having a first, lower end rotatably mounted on an upper surface of the second divider 30 for horizontal rotational movement of the opposite, upper end of the arm over the first play area 26 of the table 12.

A mobile 66 is rotatably supported on the second end of the arm, and the mobile may include a plurality of figures or icons 68 suspended from it. The mobile may be manually actuated by a child, or means may be provided for selectably causing the mobile to rotate in response to the actuation of a switch 70 on, e.g., the arm, and for generating a melodic sound in conjunction with the rotation of the mobile. In the particular embodiment illustrated in the figures, a small D.C. electric motor and gear drive located inside the mobile causes it to rotate when activated by the switch, and the exemplary circuitry 52 in the electronics compartment 48 described above can be programmed to play the desired melody through the speaker 54 and a baffle 72 located at the bottom of the compartment in conjunction with the rotation of the mobile.

The exemplary play center 10 also includes a baby monitor, comprising a first portion 74A fixed to the upper surface 16 of the table 12 and an associated second portion 74B that is portable and thus can be picked up from the table and carried about by the child, as shown by the phantom lines in FIG. 1. Preferably, means are provided for selectably generating one of a plurality of baby sounds through the fixed portion 74A of the monitor. This can be accomplished, for example, in a manner similar to that described above in connection with the faucet 42 and running water sounds.

Thus, the fixed portion 74A of the monitor can comprise an acoustic channel 76 (shown by dashed lines in FIG. 2) that is acoustically coupled to the electronics compartment 48 on the lower surface of the table 12, and the electronic circuitry 52 can be programmed to play a selected one of several pre-stored baby sounds, e.g., a "happy baby," a "sleepy baby," or a "fussy baby," either once or repetitively, in response to the actuation of a selector switch 78 on, e.g., the fixed portion, and the baby sounds will be heard by the child as coming from the fixed portion of the monitor.

The play center 10 preferably includes a separate booster chair 80 (see FIG. 1) for the doll, comprising a seat 82, a pair of arms 84, a backrest 86, a plurality of upstanding legs 88, and means for removably attaching the chair to an edge of the table 12, as for eating or washing activities.

In the embodiment illustrated, these means are effected by the provision of extensions on the arms and seat that together, define a channel 90 on the front of the chair that slides over the edge of the table and supports the chair on the table in a cantilevered fashion. As illustrated in the phantom outline of FIG. 1, this arrangement enables the booster chair to be easily removed from the table and set on the floor next to the table, e.g., for "potty training" activities, and for this purpose, the chair may further include a recessed bowl 92 below the seat, and the seat can be hinged to the chair to rotate up and back against the backrest to expose the recessed bowl, as illustrated in the figure.

As illustrated in FIGS. 1 and 2, the play center 10 can be provided with a number of accessories suitable to infant-care play activities, such as a spoon 94, a real powder dispenser 96, such as a baby powder dispenser, a baby bottle 98, a simulated bottle warmer 100, a real lotion dispenser 102, such as a baby lotion dispenser, and a bowl 104. These accessories can all be dimensioned, sized and shaped for use by a child and to be conveniently stored in the bath tub 18, below the closed cover 20 when the play center is not in use.

By now, those of skill in this art will appreciate that the infant-care play center 10 of the present invention is amenable to many variations and modifications in terms of the methods and materials of its construction without departing from its spirit and scope. For example, most of the parts of the play center can be separately and inexpensively fabricated by, e.g., injection molding a strong, smooth, colorful plastic, such as an acrylic or a polyurethane, for flat storage and packaging, and to include a myriad of molded-in functional and decorative details and features. The parts can then be assembled together quickly and simply with a minimum number of tools using well-known plug-in and snap-together techniques and molded-in connection features.

In light of the foregoing, the scope of the present invention should not be limited by that of the particular embodiments described and illustrated herein, as these are merely exemplary in nature. Rather, the scope of the present invention should be commensurate with that of the claims appended hereafter and their functional equivalents.

What is claimed is:

1. A child's infant-care play center, comprising:

a table having a substantially flat upper surface, a lower surface and a plurality of side edges supported by a plurality of upstanding legs and having a recessed bath tub for a doll formed in the substantially flat upper surface thereof;

a first upstanding divider disposed on the upper surface of the table at one side of the recessed bath tub and dividing the substantially flat surface into a first play area and a second play area with the recessed bath tub in the first play area;

a second upstanding divider disposed on the substantially flat upper surface of the table at a side of the recessed bath tub opposite to the first upstanding divider;

an upstanding headboard disposed on the substantially flat upper surface of the table adjacent to and between corresponding ends of the first upstanding divider and the second upstanding divider; and a cover removably retained in an upper rim of the recessed bath tub to allow the first play area to serve as a changing, sleeping and bathing area for a doll.

2. The play center of claim 1 wherein the second play area of the substantially flat upper surface of the table includes:

a recessed washing sink; and a recessed eating tray to allow the second play area to serve as a washing and eating area.

3. The play center of claim 1, further comprising:

a flexible conduit extending through an opening in a top surface of the first upstanding divider, the conduit having a first end with a faucet attached thereto exterior of the first upstanding divider and a second end captivated within the first upstanding divider for extensile and retractile movement of the faucet toward and away from the top surface of the first upstanding divider.

4. The play center of claim 3, further comprising:

means for selectably generating the sound of running water through the conduit and the faucet.

5. The play center of claim 4, wherein the conduit and faucet comprise an acoustic channel acoustically coupled to a compartment on the lower surface of the table, and wherein the water sound generating means is contained in the compartment.

6. The play center of claim 1, further comprising:

an arcuate support arm having a first end rotatably mounted on an upper surface of the second divider for horizontal rotational movement of a second end thereof above the first play area of the table; and, a mobile rotatably supported on the second end of the arm.

7. The play center of claim 6, further comprising:

means for selectably causing the mobile to rotate; and, means for generating a melodic sound in conjunction with the rotation of the mobile.

8. The play center of claim 1, further comprising:

a baby monitor comprising a portion fixed to the substantially flat upper surface of the table and a portable second portion; and, means for selectably generating one of a plurality of baby sounds through the fixed portion of the monitor.

9. The play center of claim 8, wherein the fixed portion of the monitor comprises an acoustic channel acoustically coupled to a compartment on a the lower surface of the table, and wherein the baby sound generating means is disposed in the compartment.

10. The play center of claim 8, wherein the plurality of baby sounds comprises:

a happy baby;

a sleepy baby; and, a fussy baby.

11. The play center of claim 1, further comprising:

a booster chair comprising a seat, a pair of arms, a backrest, a plurality of upstanding legs, and means for removably attaching the chair to an edge of the table.

12. The play center of claim 11, wherein the booster chair further includes a recessed bowl below the seat thereof, and wherein the seat is hinged to the chair to rotate up and back against the backrest to expose the recessed bowl.

13. A child's infant-care play center, comprising:

a table having a substantially flat upper surface, a lower surface and a plurality of side edges supported by a plurality of upstanding legs and having a recessed bath tub for a doll formed in the substantially flat upper surface;

a cover removably retained in an upper rim of the recessed bath tub to allow the first play area to serve as a changing, sleeping and bathing area for a doll;

a first upstanding divider disposed on the substantially flat upper surface of the table at one side of the recessed bath tub and dividing the substantially flat upper surface into a first play area having the recessed bath tub and a second play area;

a second upstanding divider disposed on the substantially flat upper surface of the table at a side of the tub opposite to the first upstanding divider; and an upstanding headboard disposed on the substantially flat upper surface of the table adjacent to and between corresponding ends of the first upstanding divider and the second upstanding divider.

14. The play center of claim 13, wherein the second play area of the substantially flat upper surface of the table includes a recessed washing sink and a recessed eating tray and a flexible conduit extends through an opening in a top surface of the first upstanding divider, the flexible conduit having a first end with a simulated faucet attached thereto exterior of the first upstanding divider and a second end captivated within the first upstanding divider for extensile and retractile movement of the faucet toward and away from an upper surface of the first upstanding divider.

15. The play center of claim 14, further comprising means for selectably generating the sound of running water through the flexible conduit and the simulated faucet and wherein the flexible conduit and the simulated faucet comprise an acoustic channel acoustically coupled to a compartment on the lower surface of the table, and wherein the water sound generating means is contained in the compartment.

16. The play center of claim 13, further comprising:

an arcuate support arm having a first end rotatably mounted on an upper surface of the second upstanding divider for horizontal rotational movement of a second end thereof above the first play area of the table; a mobile rotatably supported on the second end of the arm; a means for selectably causing the mobile to rotate; and means for generating a melodic sound in conjunction with the rotation of the mobile; a baby monitor comprising a portion fixed to the substantially flat upper surface of the table and a portable second portion; and, means for selectably generating one of a plurality of baby sounds through the fixed portion of the monitor, and wherein the plurality of baby sounds comprise a happy baby sound, a sleepy baby sound; and a fussy baby sound.

17. The play center of claim 13, further comprising a booster chair comprising a seat, a pair of arms, a backrest, a plurality of upstanding legs, and means for removably attaching the chair to one of the plurality of side edges of the table.

18. A child's infant-care play center, comprising:

a table having an upper surface, a lower surface and a plurality of side edges supported by a plurality of upstanding legs and having a recessed bath tub in the upper surface;

a cover forming a simulated changing table/bed removably retained in an upper rim of the tub;

a first upstanding divider disposed on the upper surface of the table at one side of the tub and dividing the surface into first play area and a second play area;

the second play area including a recessed washing sink and a recessed eating tray;

a flexible conduit extending through an opening in a top surface of the first upstanding divider, the flexible conduit having a first end with a simulated faucet attached thereto exterior of the first upstanding divider and a second end captivated within the first upstanding divider for extensile and retractile movement of the simulated faucet toward and away from the top surface of the first upstanding divider;

a second upstanding divider disposed on the upper surface of the table at a side of the tub opposite to the first upstanding divider;

an upstanding headboard disposed on the upper surface of the table adjacent to and between corresponding ends of the first upstanding divider and the second upstanding divider;

means for selectably generating the sound of running water through the flexible conduit and the simulated faucet;

an arcuate support arm having a first end rotatably mounted on an upper surface of the second upstanding divider for horizontal rotational movement of a second end thereof above the first play area of the table;

a mobile rotatably supported on the second end of the arm;

means for selectably causing the mobile to rotate;

means for generating a melodic sound in conjunction with the rotation of the mobile;

a baby monitor comprising a portion fixed to the upper surface of the table and a portable second portion;

means for selectably generating one of a plurality of baby sounds through the fixed portion of the monitor; and a booster chair adapted to be removably attached to one of the plurality of side edges of the table.

* * * * *